United States Patent [19]

Zimmerman, Jr. et al.

[11] 4,224,486

[45] Sep. 23, 1980

[54] SHUNT PROTECTED POWER CONNECTOR

[75] Inventors: John A. Zimmerman, Jr., Hershey; Larry L. Leitzel, Halifax, both of Pa.

[73] Assignee: AMP Incorporated, Harrisburg, Pa.

[21] Appl. No.: 17,630

[22] Filed: Mar. 5, 1979

[51] Int. Cl.[3] ..... H01R 33/30

[52] U.S. Cl. ..... 200/51.1; 339/184 M

[58] Field of Search ..... 200/51.09, 51.1; 339/75 R, 75 M, 176 MP, 184 M

[56] References Cited

U.S. PATENT DOCUMENTS

| | | | |
|---|---|---|---|
| 1,711,397 | 4/1929 | Rumble | 200/51.1 |
| 1,911,513 | 5/1933 | Kenerson | 200/51.1 X |
| 3,090,948 | 5/1963 | Cremer | 200/51.1 X |
| 3,947,080 | 3/1976 | Ege | 339/64 M |
| 4,034,172 | 7/1977 | Glover et al. | 200/51.1 |
| 4,053,724 | 10/1977 | Llona | 200/51.1 |

FOREIGN PATENT DOCUMENTS

| | | | |
|---|---|---|---|
| 1197299 | 7/1970 | United Kingdom | 200/51.1 |

*Primary Examiner*—Stephen Marcus
*Attorney, Agent, or Firm*—Russell J. Egan

[57] ABSTRACT

A power connector includes a shunting bar which will shunt the terminals of one mating member prior to unmating of the connector and maintain the shunt condition during the initial phases of mating of the connector. This connector finds particular use where it is desirable to shunt the secondary of a current transformer when a control module is removed. Likewise the connector can be used to insure discharge of capacitance from associated circuitry thereby making them safe to handle.

10 Claims, 4 Drawing Figures

SHUNT PROTECTED POWER CONNECTOR

BACKGROUND OF THE INVENTION

1. The Field of the Invention

The present invention relates to an electrical connector and in particular to a shunt protected power connector which will assure shunting of the terminals in one mating half upon disconnect with those terminals remaining shunted until they are at least partially engaged with the other half upon remating of the connector.

2. The Prior Art

There are many instances when it is desirable or essential to shunt terminals of unmated electrical connectors in order to both protect associated circuitry and personnel handling the equipment. For example, in power distribution control equipment it is essential to short out the secondary of a current transformer when a control module is removed. If this is not done, then there is substantial probability of the current transformer burning up and/or exploding in a condition of no load on the secondary.

Another example is in high voltage situations in which connectors intermate with terminals secured to the ends of cables and/or other portions of equipment. The connector usually carries plural conductors which apply high voltage to a load or a current source and comprise the return path from the load or the current source. When the connectors are disconnected, the load or current source may have some residual voltage, even though the supply voltage has been disconnected. The contacts of an unmated connector block are exposed and thereby provide a danger of electrical shock from the residual voltage. One way to minimize the danger of electrical shock is to recess the exposed electrical contacts as far as possible within the confines of the connector block. The contacts, although recessed, are yet exposed and freely accessible through the connector block cavities. Thus, there remains the possibility of shock occurring from accidental contact engagement with the contacts.

The prior art has used many approaches in an attempt to overcome the above mentioned difficulties. For example, U.S. Pat. No. 4,034,172 shows a high voltage connector in which the contacts are deeply recessed within the connector and a crow bar assembly is included. The crow bar assembly serves to short the terminals of the connector upon unmating of the connector members.

U.S. Pat. No. 3,275,765 shows an electrical connector which includes a switching means whereby the terminals are shorted one to another upon unmating of the connector members. U.S. Pat. No. 3,387,104 shows a third approach to the problem in which an actual switching member is included in one connector half. The switch is held in an open position by the mated connector but is allowed to close and short the terminals of the connector upon unmating of the connector members.

SUMMARY OF THE PRESENT INVENTION

The present shunt protected power connector includes shunting bar means in one mating connector member which will shunt together the terminals of that member upon unmating. The shunting bar means includes at least one shunting bar extending transversely across the width of the member and at least one spring member normally biasing the shunting bar into engagement with electrical terminals mounted in the member. The mating connector member includes at least one ramp portion which lifts a respective shunting bar from the terminals upon mating of the connector members. Preferably the terminals of the mating member project beyond the ramp so that there is engagement of the terminals prior to removal of the shunting bar from the terminals. The ramp can also be designed to provide both an audible and tactile sensing of when the shunting bars are engaged by the ramp and when the shunting bars are actually removed from engagement with the terminals.

It is therefore an object of the present invention to produce a shunt protected power connector having means to positively shunt terminals thereof upon unmating of the connector and to keep said terminals in a shunted condition until the connector is substantially fully mated.

It is another object of the present invention to produce a shunt protected power connector which will short out the secondary of a current transformer when a control module is removed.

It is a further object of the present invention to produce a shunt protected power connector which will assure discharge of associated circuitry upon unmating of the connector thereby avoiding the possibility for the hazard of electrical shocks created.

It is a still further object of the present invention to provide a shunt protected power connector which can be readily and economically produced.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
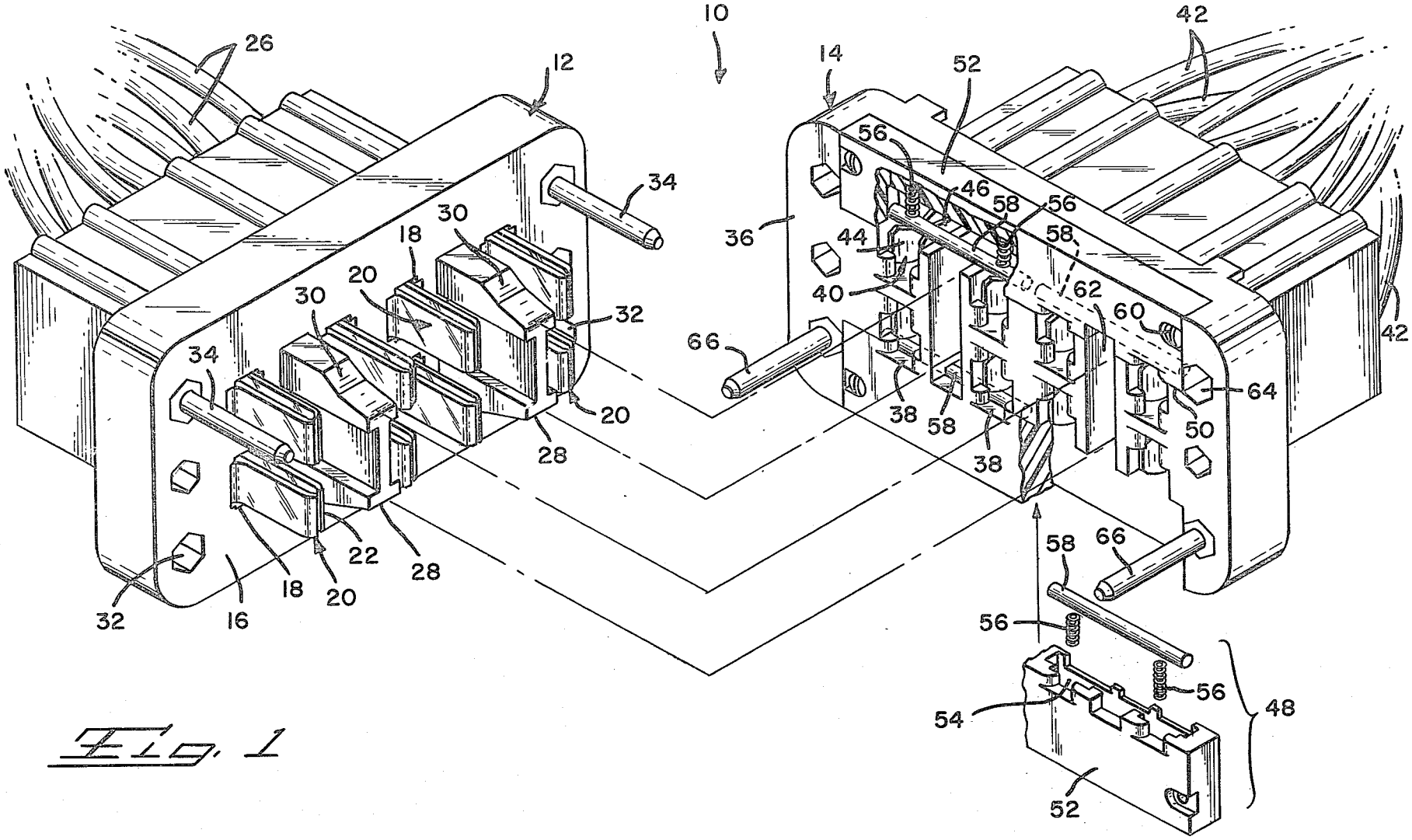
FIG. 1 is an exploded perspective view, partially in section, of the subject shunt protected power connector.

The subject shunt protected power connector 10 includes a plug member 12 and a mating receptacle member 14. The plug member 12 includes a housing of rigid dielectric material having a mating face 16 with a plurality of terminal passages 18 extending through the housing and opening on the mating face 16. A male electrical terminal 20 is mounted in each passage with each terminal having a bladelike mating portion 22 extending from the mating face 16 and a conductor engaging portion 24 terminating a respective conductor 26 and lying totally within the housing. The male terminal 20 illustrated is similar to the plug contact 4 described in U.S. Pat. No. 3,155,449, the disclosure of which is incorporated herein by reference. The conductor engaging portion 24 has been shown as a well known crimp barrel but any suitable means, such as insulation displacement, can also be used. The plug member 12 also includes at least one projection 28 extending from the mating face 16. The projection 28 includes at least one profiled ramp 30, the longitudinal dimension of which is normal to the mating face 16. The plug member 12 further is provided with polarizing means including apertures 32 and at least one stud 34 mounted in a respective aperture.

The receptacle member 14 likewise includes a housing of rigid dielectric material having a mating face 36 with a plurality of terminal passages 38 extending from the mating face through the connector body. A female terminal 40 is positioned in each passage and terminates a respective conductor 42. The female terminal 40 has a mating portion formed by a pair of closely spaced blades 44, 46 which receive therebetween the mating blade portion 22 of the respective male terminal 20. The female terminal 40 is similar to the socket contact 2 described in U.S. Pat. No. 3,155,449, the disclosure of which is incorporated herein by reference. The receptacle member 14 further includes at least one shunt assembly 48 per row of terminals 40. Each shunt assembly 48 is received in a recess 50 in the mating face 36 of the receptacle housing. The shunt assembly 48 included a housing block 52 having a longitudinally extending recess 54 directed toward the terminals to be shunted. This recess can also be transversely profiled to conform to the terminal passages 38 and the mating face 36. At least one blind bore 55 is formed in the base of each recess 54 and receives a spring 56 therein. A shunt bar 58 is received in the recess against the bias of springs 56. The shunt assembly 48 is secured in the housing by fastening means 60 with bar 58 normally resting against terminals 40. The receptacle member further includes at least one projection receiving recess 62 in the mating face 36 aligned to receive a respective projection 28 of the plug member 12 as well as polarizing means including apertures 64 and at least one stud 66. The apertures 32 and 64 of the respective housings are in alignment and each stud 34, 66 is positioned to be received in a respective aperture in the opposite member.

Figure 2:
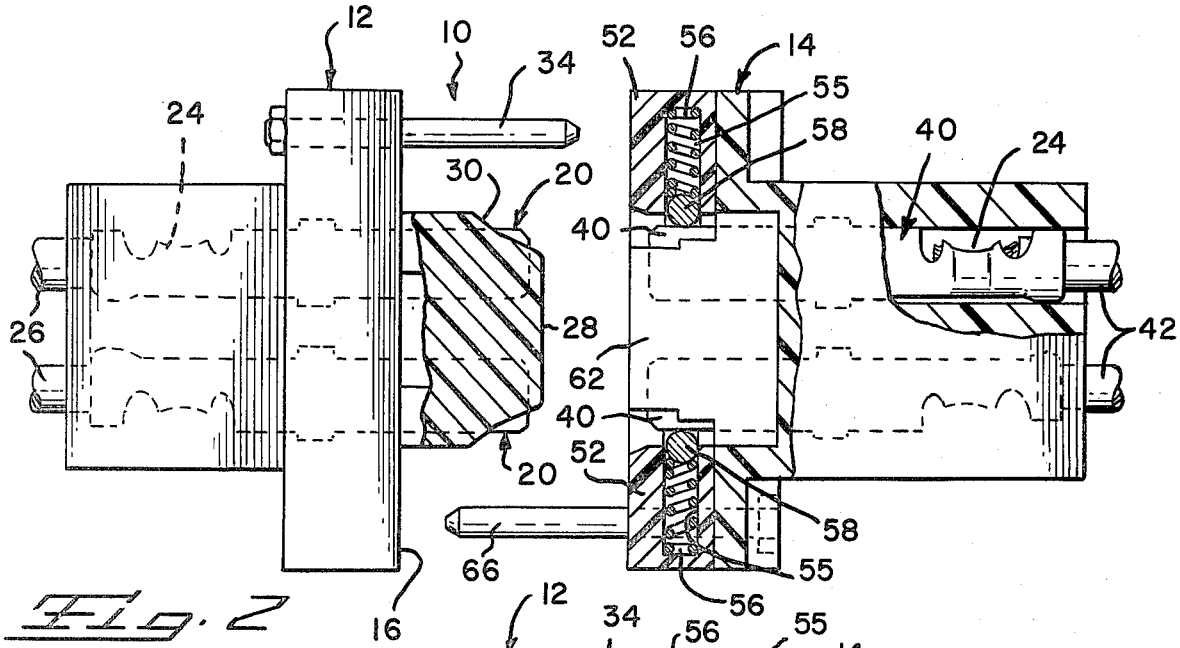
FIG. 2 is a side elevation, partly in section, showing the members of the subject electrical connector in an aligned but unmated condition.
Figure 3:
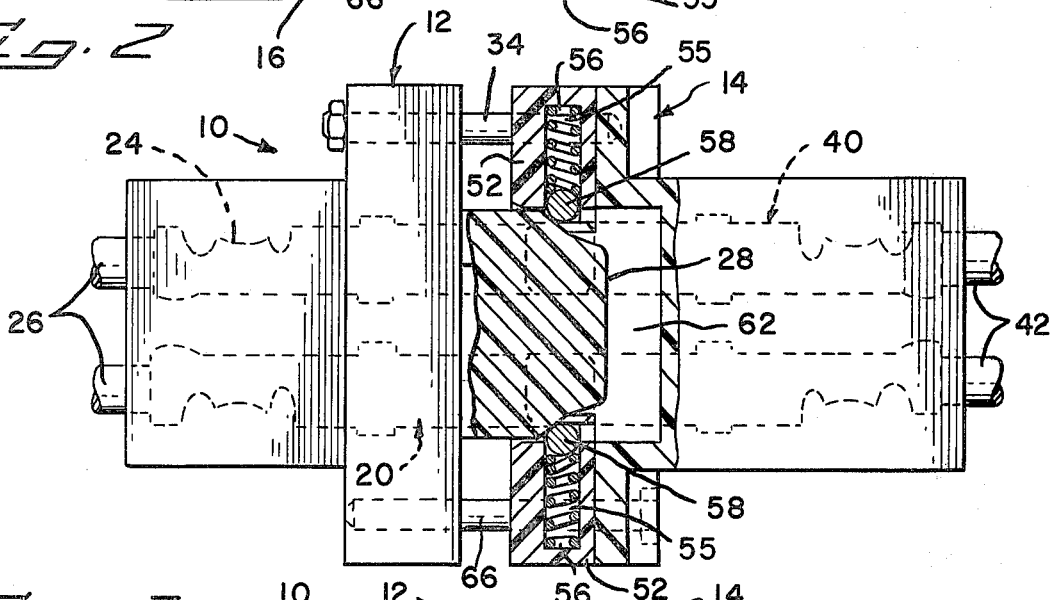
FIG. 3 is a view similar to FIG. 2 showing the members of the subject connector in a partially mated condition.
Figure 4:
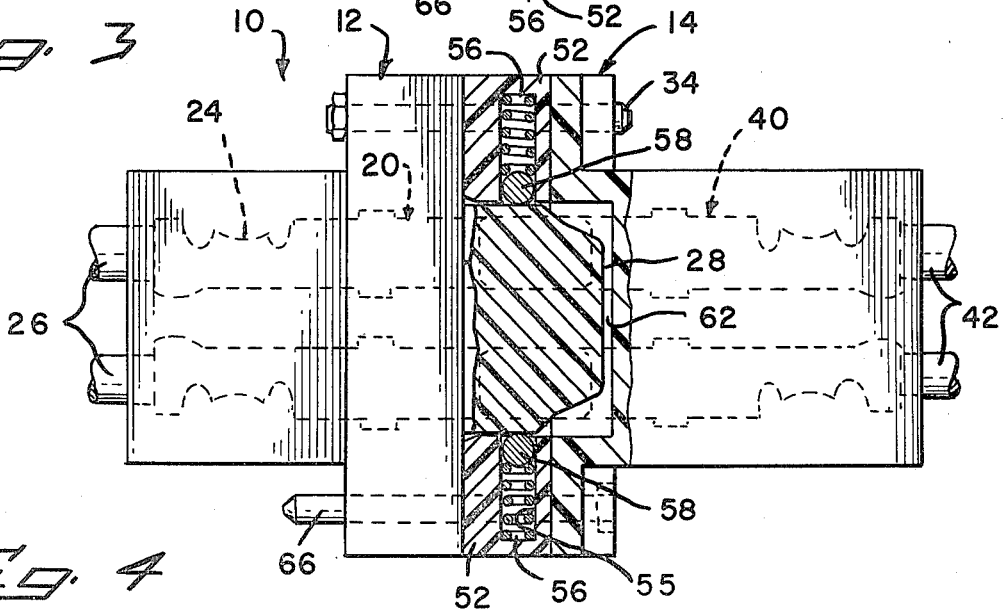
FIG. 4 is a side elevation similar to FIGS. 2 and 3 showing the subject connector in a fully mated condition.

The operation of the subject connector can be clearly understood from FIGS. 2 through 4. In FIG. 2 members are not mated so that the shunt bars 58 are fully engaged with the respective terminals 40 thereby assuring shunting of associated circuitry.

In FIG. 3 the connector members have been partially mated so that the male terminals 20 are engaged in the female terminals 40 but the shunt bar 58 is still biased against terminals 40. At this point the shunt bar 58 is engaged with the ramp surface 30 of the projection 28 and will provide both a tactile and audible indication of the members having reached this partially mated position. Further movement of the connector members to the fully mated position, as shown in FIG. 4, causes the shunt bars 58 to be lifted up by the ramp surfaces 30 out of engagement with the terminals 40. It will be appreciated that upon unmating of the connector members, the shunt bars 58 will move down the ramps 30 and engage the terminals 40 prior to the unmating of the terminals 20 and 40 thereby assuring a shunt condition prior to the unmating of the connectors.

The present invention may be subject to many modifications and changes without departing from the spirit or essential characteristics thereof. The present embodiment should therefore be considered in all respects as illustrative and not restrictive of the scope of the invention.

What is claimed is:

1. A shunt protected power connector comprising:

a pair of mating plug and receptacle members, said plug member having a housing of insulative material with a mating face, a plurality of terminal passages extending through said housing and opening onto said face, a like plurality of terminals each mounted in a respective one of said passages with one end extending at least part way from said face and the other end terminating a respective conductor, and at least one rigid projection extending normal to said face and having a profiled surface;

said receptacle member including a housing of insulative material having a mating face, a like plurality of terminal passages extending through said housing and opening on said face, each said passage in said receptacle housing being aligned with a respective passage in said plug housing, a like plurality of terminals each mounted within a respective one of said passages with one end adapted to mate with a respective terminal of said plug member and the other end terminating a respective conductor, shunt means extending transversely to and impinging upon each said terminal passage, said shunt means including at least one elongated first recess in said mating face adjacent to and opening on a row of passages; and auxiliary housing block mounted in each said elongated first recess; a groove in and extending the length of said auxiliary housing block and being directed towards said passages; at least one shunt bar lying in said groove; at least one blind bore in a base of said groove; spring means in each said blind bore acting against said shunt bar, and at least one second recess in said mating face each adapted to receive a respective one of said at least one projection of said plug member therein whereby the profiled surface of said projection engages said shunt bar upon partial mating of said members and lifts it out of engagement with said terminals upon substantially complete mating of said members.

2. The shunt protected power connector according to claim 1 wherein said profiled surfaces of said projections provide both tactile and audible indication of engagement with said shunt bar and full mating of said connector.

3. The shunt protected power connector according to claim 1 wherein said profiled projection includes:

a first portion dimensioned to pass beneath said shunt bar upon initial mating of said connector members, a second portion forming an abutment against which said shunt bar strikes when the connector members reach a position in which the terminals are partially mated, a third contiguous ramp portion which causes said shunt bar to be lifted from said terminals upon continued mating of said members, and a fourth portion upon which said shunt bar rests spaced from said terminals in a fully mated condition of said members.

4. A shunt protected connector according to claim 1 further comprising:

polarizing means on said members assuring correct mating thereof.

5. A shunt protected connector according to claim 1 wherein:

said terminals in said plug member are male terminals; and said terminals in said receptacle are female terminals.

6. A shunt protected power connector comprising:

a pair of mating plug and receptacle members, said receptacle member including a housing of insulative material having a mating face, a plurality of terminal passages extending through said housing and opening on said face, a like plurality of terminals each mounted within a respective one of said passages with one end adapted to mate with a respective terminal of said plug member and the other end terminating a respective conductor, shunt means extending transversely to and impinging upon each said terminal passage, said shunt means including at least one shunt bar and means to bias each said at least one said shunt bar towards said terminals, and at least one recess in said mating face adapted to receive a projection of said plug member therein;

said plug member having a housing of insulative material with a mating face, a like plurality of terminal passages extending through said housing and opening onto said face, each said passage in said plug housing being aligned with a respective passage in said receptacle housing, a like plurality of terminals each mounted in a respective one of said passages with one end extending at least part way from said face and the other end terminating a respective conductor, and at least one rigid projection extending normal to said face and having a profiled surface including a first portion dimensioned to pass beneath said shunt bar upon initial mating of said connector members, a second portion forming an abutment against which said shunt bar strikes when the connector members reach a position in which the terminals are partially mated, a third contiguous ramp portion which causes said shunt bar to be lifted from said terminals upon continued mating of said members, and a fourth portion upon which said shunt bar rests spaced from said terminals in a fully mated condition of said members, whereby the profiled surface of said projection engages said shunt bar upon partial mating of said members and lifts it out of engagement with said terminals upon substantially complete mating of said members.

7. A shunt protected power connector according to claim 6 wherein said profiled surfaces of said projections provide both tactile and audible indication of engagement with said shunt bar and full mating of said connector.

8. A shunt protected connector according to claim 6 further comprising:

polarizing means on said members assuring correct mating thereof.

9. A shunt protected connector according to claim 6 wherein:

said terminals in said plug member are male terminals; and said terminals in said receptacle are female terminals.

10. The shunt protected power connector according to claim 6 further comprising:

at least one elongated second recess in said mating face adjacent to and opening on each of a row of passages;

an auxiliary housing block mounted in each said recess;

a groove in and extending the length of said auxiliary housing block and being directed towards said passages;

said at least one shunt bar lying in said groove;

at least one blind bore in a base of said groove;

said means to bias said shunt bar comprising spring means in each said blind bore acting against said shunt bar.

* * * * *